United States Patent [19]

Jansa et al.

[11] 4,195,824

[45] Apr. 1, 1980

[54] JIG FOR TENSION ELEMENTS FOR METALLURGIC VESSELS, PARTICULARLY ALTERNATING CONVERTERS

[75] Inventors: Wolfgang Jansa, Moers; Erhard Pfeil, Duisburg; Paul Waldhorst, Gelsenkirchen, all of Fed. Rep. of Germany

[73] Assignee: DEMAG, Aktiengesellschaft, Duisburg, Fed. Rep. of Germany

[21] Appl. No.: 972,814

[22] Filed: Dec. 26, 1978

[30] Foreign Application Priority Data

Jan. 27, 1978 [DE] Fed. Rep. of Germany ..... 2803457

[51] Int. Cl.[2] ..... C21C 5/42

[52] U.S. Cl. ..... 266/246; 266/243

[58] Field of Search ..... 266/243-248; 75/60

[56] References Cited

U.S. PATENT DOCUMENTS

| | | | |
|---|---|---|---|
| 3,536,310 | 10/1970 | Kalb | 266/246 |
| 3,771,777 | 11/1973 | Fisher | 266/246 |
| 3,773,497 | 11/1973 | Grenfell | 75/60 |
| 3,910,654 | 10/1975 | Schwarz | 266/246 |
| 3,951,390 | 4/1976 | Krause | 266/243 |

FOREIGN PATENT DOCUMENTS

| | | | |
|---|---|---|---|
| 1911948 | 10/1973 | Fed. Rep. of Germany | 266/243 |

*Primary Examiner*—P. D. Rosenberg

*Attorney, Agent, or Firm*—Mandeville and Schweitzer

[57] ABSTRACT

The invention refers to a jig clamping device for tension elements for metallurgic converters, particularly alternating converters which are cocked or tightened at their vessel bearing projections or extensions against the corresponding counterbearings of the annular support or frame for the vessel with at least one tension element, consisting of a hydraulic piston-cylinder unit transmitting tensile force onto the tension element.

10 Claims, 5 Drawing Figures

JIG FOR TENSION ELEMENTS FOR METALLURGIC VESSELS, PARTICULARLY ALTERNATING CONVERTERS

BACKGROUND AND STATEMENT OF THE INVENTION

The tension elements for metallurgic vessels have different heat expansion coefficients between the extremely hot vessel and structural parts surrounding the vessel, which are lower in temperature, such as open or closed annular supports, tilting frames, cradles, suspensions for cranes, and the like. As essential property of the tension elements consists in their flexibility versus forces which are effective vertically to the tension element axis.

Jigs for such tension elements serve the purpose of cocking the metallurgic vessel against its supporting device in a reference position, usually in a vertical position, in such a fashion that at least the weight of the vessel, together with its contents is compensated by the entire tensile force of several tension elements. Furthermore, the tension elements are also designed so that several individual tensile forces, whose sum is greater than the weights of vessel with contents, may be produced in one tension element.

As a rule, a metallurgic vessel, such as an alternating or interchangeable converter, is kept in its annular support by about four to eight tension elements. It is known to design the tension device required for the jig work and the four to eight tension elements as a mobile unit, which is kept available on the platform for the alternating vessel truck. According to the task at hand, the work area on a platform of an alternating vessel truck, as well as on other platforms beneath the metallurgic vessels, is limited. Experience has shown that the vehicle for the tension device or jig requires a certain amount of space, which could advantageously be reserved for other aggregates or for the staff. Furthermore, practice has shown that the mobile jigs must be brought rather accurately under the tension elements for proper adjustment. The time necessary for this operation is repeated with each individual tension element and represents additional work.

The present invention is based on the idea of omitting the mobile jig, and replacing it with a new device which is more easily adjusted with the tension elements, so that time may be saved for adjustment and tension operations. This is achieved by having each vessel bearing projection and/or its respective counterbearing coordinated with at least one hydraulic piston-cylinder unit operable in axial direction of the tension element, and in the sense of an elongation of the latter, between the anchor or tie head arranged on one side and the tightening nut on the other side of the respective tension element, such piston-cylinder unit being concentric with the tension element axis and parallel with the course of the tensile force of the operation. Thus, in operating position of the device, tensile force going through the tie head, the tension element, the tightening nut, the counterbearing, and the vessel bearing projection forms a closed force circle.

The new jig is thus coordinated with each individual tension element and is no longer moved. Of particular advantage is the fact that adjustment work to the extent which occurs when setting up a jig on a truck, is no longer necessary. Another advantage is the time saved for adjusting the jig, which is always ready for operation. This immediate readiness for operation is of particular importance during alternating operation, where the vessel must be removed from the tilting mount at certain intervals and replaced by a new vessel. The invention also makes it easier to take tests in short intervals of the respective tensile forces existing in the tension elements. This control has considerable advantages and increases the safety for smooth operation of the vessel installation. Also, rather than one large piston-cylinder unit, the invention may provide several piston-cylinder units around the cross sectional circumference of the tension element. A very space-saving arrangement is to provide the invention with one single annular piston-cylinder unit concentric with the cross section of the tension element.

In case there is a considerable distance between the vessel bearing projection and the respective counterbearing, matching roughly the length of the tension element, another improvement of the invention provides that the piston-cylinder unit or units are arranged between pressure sleeves which, when actuating the expansion piston, rest on one side against the counterbearing, and on the other side against the anchor head. These structural parts filling in the distance simultaneously serve to adjust the piston-cylinder unit, and to protect the tension element.

The parallel arrangement of the piston-cylinder unit with the tensile force of the operation requires a clear division of the power transfer from the expansion piston onto the tensile force cycle during operation. This division is achieved, according to another detail of the invention, by providing that the piston-cylinder unit and the pressure sleeves in operating position are together shorter in length than the distance of the support areas provided for the pressure sleeves. The arrangement of all parts of the jig can be even more space-saving if one of the pressure sleeves rests on the anchor head of the tension element, and the other on a support area at a counterbearing pertaining to the bearing projection or extension of the vessel.

Adjustment of the jig during assembly can be facilitated by providing the support area of the counterbearing for one pressure sleeve at an annular plate, which is equipped with clearance matching the pressure area of the sleeve. As the piston-cylinder unit is preferably arranged inside the respective structural part and favorably operated from the outside, it is advantageous that the pressure sleeve coordinated with the anchor head, as well as the anchor head itself, be provided with hydraulic supply and discharge lines for the pressure medium. A particularly advantageous approach, according to the invention, for providing the expansion cylinders with pressure medium is to connect the hydraulic connections for supply and discharge lines to the anchor head by means of clutches to the lines of the pressure sleeves and/or the cylinder.

The assembly of the jig is facilitated by having the pressure sleeve, which is coordinated with the anchor head, formed into two parts divided along the axis plane. The supply of pressure medium to the jig and/or expansion cylinder can be made with a minimum of effort by connecting the hydraulic connections of the anchor head to a portable or mobile pump for the hydraulic pressure medium.

The contact of the tightening nut, the transfer of the tensile force of the operation, as well as assembly and removal of the vessel is further facilitated by having the tightening nut rest on a plate supported on the vessel bearing projection, such plate bearing segments in a plane vertical to the longitudinal axis of the tension element folding around axes running parallel with the tension element axis.

Thermal stress in many cases is inevitable in metallurgic vessels, even if the respective structural parts serving to retain the vessel, can be cooled properly. In the present case, cooling of the hydraulic pressure unit is achieved by surrounding the cylinder of the piston-cylinder unit at ambient temperatures of greater than 150° C., with a cooling and supporting shell provided with cooling medium connections.

An example of the invention is shown in the drawings and explained as follows:

DETAILED DESCRIPTION OF THE INVENTION

Figure 2:
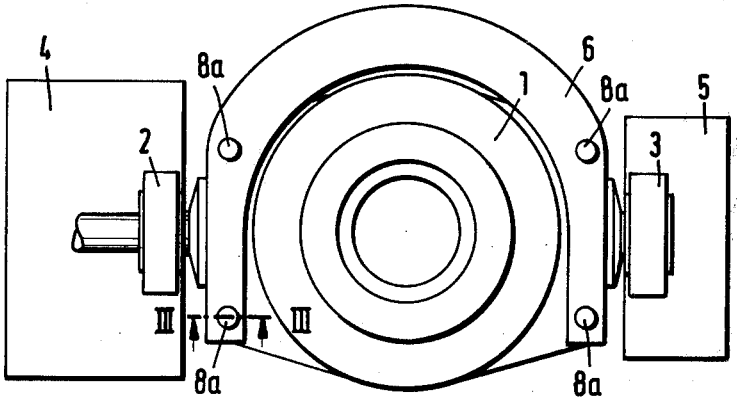
FIG. 2 is a top plan view of the apparatus of FIG. 1.

The example shown in the drawings is a steel mill converter 1, supported as an alternating vessel in pivot bearings 2 and 3, forming the tilting mount with supports 4 and 5. The steel mill converter 1 is suspended in annular support 6, while the annular support is pivotally mounted in pivot bearings 2 and 3 by pivot pins 6*a* and 6*b*. The annular support may either be a closed circle, or U-shaped, as shown in FIG. 2. The steel mill converter 1 is provided with a claw ring fixed on vessel shell 1*a*, or with individual claws, with either forming the above-mentioned vessel bearing projections 7*a*, 7*b*. The annular support forms the counterbearing surfaces 6*c*, 6*d*. Tension elements 8 rest their anchor heads 8*a* on the annular support 6.

The tension elements 8 consist of bars or bundles of individual wires, which are easily deflected at an angle to the longitudinal axis and are flexible. At the other end of the tension element tightening nuts 8*b* are screwed onto thread sections. Before tightening the nuts 8*b*, the jig of the invention is used in order to transfer the desired tensile forces permanently to the tension elements 8. In tensed position of tension elements 8, of which four are shown in FIG. 2, the tightening nuts 8*b* can be screwed tight effortlessly, and thereafter the jig is released or disengaged. The tensile force set by the jig will then remain in the tension element 8. This tensile force only changes when tilting the steel mill converter 1, in accordance with whether the weight of the steel mill converter is suspended from the tension elements 8, or rests on the annular support 6. With the latter, the tension elements 8 are then released.

The jig of this invention is, in accordance with the basic idea of the invention, arranged stationary at each of the four shown tension elements 8. The structure at each tension element is as follows (FIG. 3): In the vessel bearing projection 7*b* and/or counterbearing 6*c* of the annular support 6, the tension element 8 goes through openings formed by the structural elements described hereafter. An annular plate 9 is attached to the annular support counterbearing 6*c*. Further annular bearing plates 10 and 11 rest on the vessel bearing projection 7*b*, which itself forms a rigid box 7*c* with openings 12.

Figure 3:
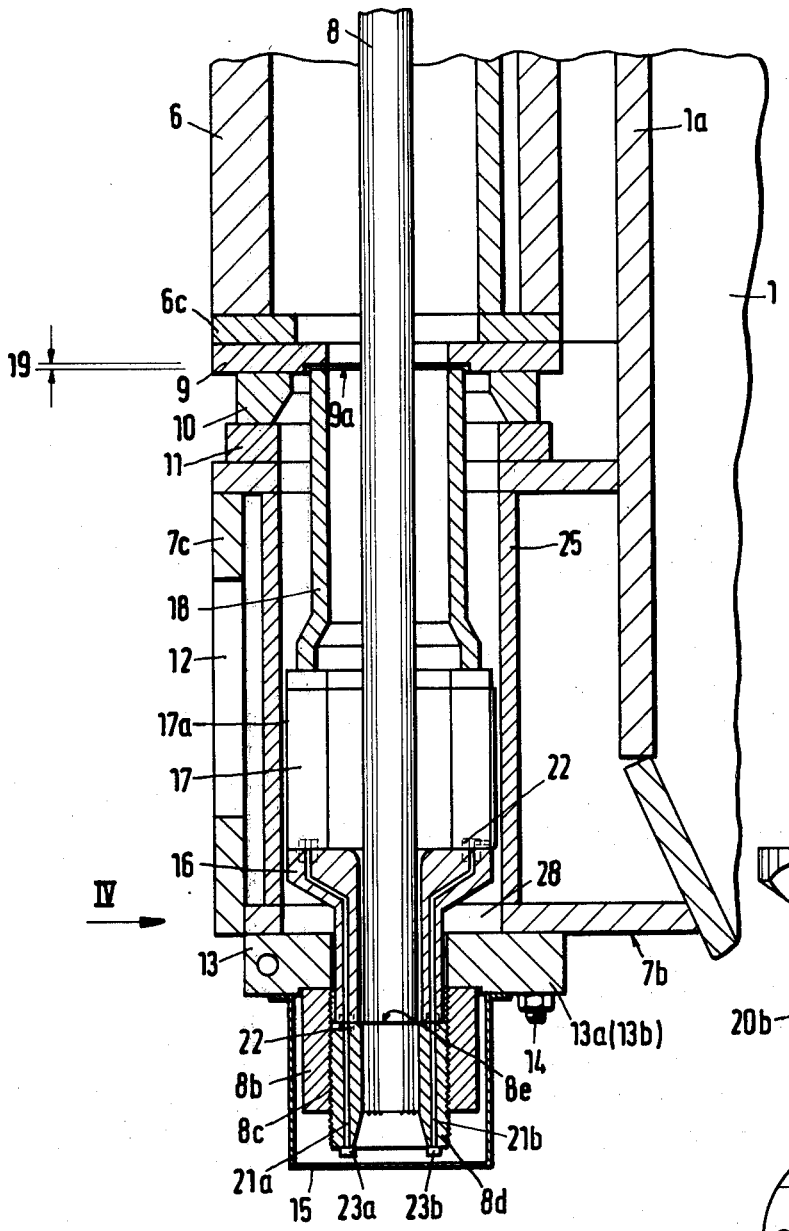
FIG. 3 is an enlarged vertical sectional view taken along lines III—III of FIG. 2.

At the bottom of vessel bearing projection 7*b*, plate 13 is screwed down tight. However, for technical reasons during assembly, two segments 13*a*, 13*b* form plate 13 and fold together around axis 14 in horizontal direction. FIG. 3 shows the operating condition of the steel mill converter. In this condition, plate 13 rests against the tightening nut 8*b*, which, by means of thread 8*c*, takes on the tensile force from the second anchor head 8*d* of tension element 8, and finally is supported against vessel projection 7*b*. Tightening nut 8*b* and anchor head 8*d* are surrounded by protective cap 15.

A first pressure sleeve 16 rests on anchor head 8*d*. Cylinder 17*a* of piston-cylinder unit 17 rests on pressure sleeve 16. The second pressure sleeve 18 fills the remaining distance between the piston-cylinder unit 17 and the annular support counterbearing 6*c*, leaving residual clearance 19 of about 10 mm, which is yet to be explained, between the support area 9*a* of the counterbearing plate 9 and the support area 8*e*.

Figure 1:
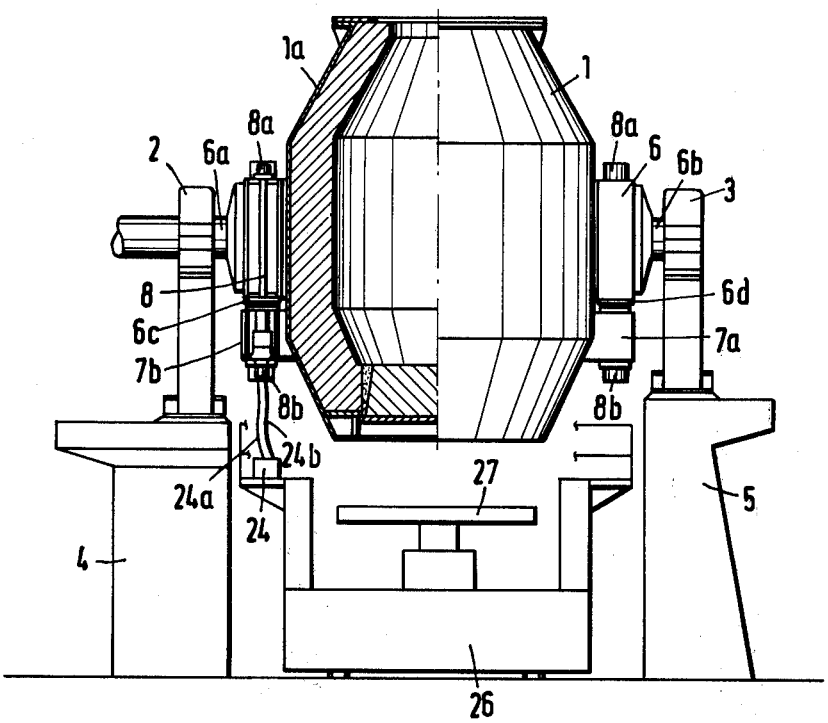
FIG. 1 is a side elevational view, partly in section, of a metallurgical interchangeable converter vessel positioned in a tiltable mount illustrating the invention.
Figure 4:
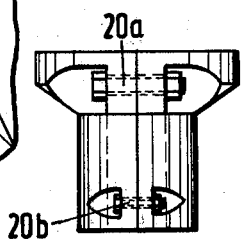
FIG. 4 is a side elevational view of the lower pressure sleeve shown in FIG. 3 in the direction of arrow IV.
Figure 5:
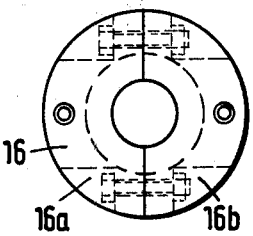
FIG. 5 is a top plan view of FIG. 4.

Assembly and/or disassembly of the jig is also made easier by the fact that (FIGS. 4 and 5) the pressure sleeve 16 is formed by mirror image parts 16*a*, 16*b* which are kept together by means of screws 20*a* and 20*b*. Supply and discharge lines 21*a* and 21*b* for hydraulic fluid run along parts 16*a* and 16*b*, as well as in the anchor head 8*d*, as shown in FIG. 3. The lines 21*a* and 21*b* are connected by means of clutches 22 at the partition areas of pressure sleeve 16 and/or cylinder 17*a* and anchor head 8*d*. The anchor head 8*d* is provided with hydraulic connections 23*a* and 23*b*, to which the priming and return pipes 24*a*, 24*b* (FIG. 1) of a portable or mobile pump 24 may be connected. FIG. 3 further shows the above-mentioned cooling and supporting shell 25, which is only required for the height of cylinder 17*a* of the piston-cylinder unit 17, in order to exercise the desired cooling effect on the pressure medium, i.e. the hydraulic fluid.

For the exchange of steel mill converter 1, the vessel alternating truck 26 drives under the vessel (FIG. 1) and takes on the weight of the vessel after lifting the hoisting plate 27 into the proper elevation. The next step is connecting the portable pump 24 to the hydraulic connections 23*a* and 23*b*. The hydraulic pressure expands the piston of the piston-cylinder unit 17 together with pressure sleeve 18, so that clearance 19 is eliminated and, after an increase in pressure, the tension element 8 is subject to elongation, so that the tightening nut 8*b* no longer rests on plate 13.

In this position, the tightening nut 8*b* is easily turned. After several turns of the tightening nut 8*b*, maintenance of the tensile force is no longer required in tension element 8, i.e. cylinder 17*a* is released up to pressure point zero. After removal of the pump 24 and segments 13*a*, 13*b*, the steel mill converter 1 can be detached by removing pressure sleeve 18, piston-cylinder unit 17 and pressure sleeve 16 through opening 28. As soon as the work has been completed on all tension elements 8, the steel mill converter 1 with hoisting plate 27 is lowered and brought to a treatment stand by means of the vessel alternating truck 26. The installation of the newly lined steel mill converter 1 takes place in the reverse sequence of the above described operations. To test the tensile forces in the tension elements 8, it is not necessary to disassemble the parts as described. This test can be performed at any time. All that is required to test the tensile forces in the tension element is to connect the portable or mobile pump 24 to connections 23*a* and/or 23*b* together with a pressure meter. The pressure meter can, with proper calibration and scale, be designed in such a fashion that the existing tensile forces can be read in the order of tons.

We claim:

1. Apparatus for providing a permanently fixed tension mounting for interchangeable metallurgic converter vessels, comprising (a) an annular support for said vessels;

(b) bearing extensions fixed on said vessels;

(c) opposed cooperating bearing surfaces on said annular support and said bearing extensions; the improvement characterized by (d) a plurality of circumferentially spaced elongated vertical tension elements extending between said opposed bearing surfaces;

(e) an anchor head on one end of each of said tension elements;

(f) a tightening nut on the opposite end of each of said tension elements from said anchor head;

(g) at least one fluid actuated piston-cylinder means concentric with each said elongated tension element; and (h) each said piston-cylinder means extensible with the longitudinal extent of its respective tension element;

(i) whereby upon mounting a said metallurgic vessel in said annular support and the tensile force thereof going through each said anchor head, each said tension element, its respective tightening nut, and the opposed bearing surfaces from a closed circle of force.

2. The apparatus of claim 1, further characterized by (a) a plurality of piston-cylinder units circumferentially spaced around each of said elongated tension elements.

3. The apparatus of claim 1, further characterized by (a) a pressure sleeve positioned at each end of each said piston-cylinder unit; and (b) one of said pressure sleeves resting against its respective anchor head and the other of said pressure sleeves resting against said opposed bearing surface on said annular support.

4. The apparatus of claim 3, further characterized by (a) the length of each said piston-cylinder unit and its respective pressure sleeves is less than the mounting length therefor in the operating position of said apparatus.

5. The apparatus of claim 4, further characterized by (a) an annular bearing plate positioned between said annular support bearing surface and each of the said adjacent bearing sleeves;

(b) a support area on each said annular bearing plate for receiving its respective adjacent bearing sleeve; and (c) a longitudinally extending clearance space between said support area and said bearing sleeve;

(d) said clearance space equal to the said combined length deficiency of each said piston-cylinder unit with its respective pressure sleeves.

6. The apparatus of claim 5, further characterized by (a) a second anchor head adjacent each of said locking nuts;

(b) fluid pressure supply and discharge lines for each said piston-cylinder unit in each said second anchor head and its associated adjacent pressure sleeve.

7. The apparatus of claim 6, further characterized by (a) clutches disposed in said fluid pressure supply and discharge lines at the juncture between each pressure fluid piston-cylinder unit and its adjacent said pressure sleeve and said second anchor head.

8. The apparatus of claim 7, further characterized by (a) each said pressure sleeve adjacent a said second anchor head is formed of two equal and opposed halves.

9. The apparatus of claim 8, further characterized by (a) a locking plate disposed between each said second anchor head and its adjacent pressure sleeve; and (b) each said locking plate formed of two halves pivotal on a single vertical axis.

10. The apparatus of claim 9, further characterized by (a) an annular cooling and supporting shell surrounding each said piston-cylinder unit.

* * * * *